United States Patent [19]

Ewing

[11] Patent Number: 4,937,633

[45] Date of Patent: Jun. 26, 1990

[54] CLEANING BLADE DEFECT SENSING ARRANGEMENT

[75] Inventor: Joan R. Ewing, Fairport, N.Y.

[73] Assignee: Xerox Corporation, Stamford, Conn.

[21] Appl. No.: 382,889

[22] Filed: Jul. 21, 1989

[51] Int. Cl.[5] ..... G03G 21/00

[52] U.S. Cl. ..... 355/299; 355/203; 15/256.5

[58] Field of Search ..... 355/203, 299; 15/256.5, 15/256.51; 324/71.1

[56] References Cited

U.S. PATENT DOCUMENTS

| | | | |
|---|---|---|---|
| 4,319,831 | 3/1982 | Matsui et al. | 355/15 |
| 4,465,362 | 8/1984 | Tohma et al. | 35/203 X |
| 4,501,486 | 2/1985 | Landa | 355/15 |
| 4,819,026 | 4/1989 | Lange et al. | 355/15 |

FOREIGN PATENT DOCUMENTS 61-122679 6/1986 Japan .

OTHER PUBLICATIONS

Xerox Disclosure Journal; "Impregnated Poromeric Material Cleaning Blade"; Spencer et al.; vol. 1, No. 4, Apr. 1976, p. 79.

*Primary Examiner*—Joan H. Pendegrass
*Attorney, Agent, or Firm*—Mark Costello

[57] ABSTRACT

An elastomeric cleaning blade supported in cleaning relationship with the imaging surface of an electrophotographic device, for removal of residual toner on the surface, is provided with a cleaning edge having predetermined and detectable characteristics of the cleaning blade. An electrical signal is applied to the cleaning edge, and variations in the electrical characteristics are monitored. Change in the electrical characteristics of the cleaning blade edge will be highly indicative of a cleaning blade failure, or impending failure. A signal based on the variation in electrical characteristics may be produced to create a warning indication or cause a corrective response to occur.

27 Claims, 5 Drawing Sheets

CLEANING BLADE DEFECT SENSING ARRANGEMENT

This invention relates to reproduction apparatus, and more particularly, to an arrangement for sensing failure of a cleaning blade.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly.

Although a preponderance of the toner forming the image is transferred to the paper during the transfer step, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom. Blade cleaning is a highly desirable method for removal of residual toner and debris (hereinafter, collectively referred to as "toner") from a charge retentive surface, because it provides a simple, inexpensive structure compared to the various fiber or magnetic brush cleaners that are well known in the dry electrophotography art. In a typical application, a relatively thin elastomeric cleaning blade member is provided and supported adjacent the charge retentive surface, transverse to the direction of relative movement, with a blade edge chiseling or wiping toner from the surface. Subsequent to release of toner from the surface, the released toner accumulating adjacent the cleaning blade is transported away from the cleaning blade area by a toner transport arrangement or gravity. Unfortunately, blade cleaning suffers from certain deficiencies, primarily resulting from the frictional sealing contact which must be maintained between the cleaning blade and the charge retentive surface. Friction between the surfaces causes wearing away of the blade edge, and damaging wearing contact with the charge retentive surface. To reduce friction, various blade lubricating materials or toner lubricant additives have been proposed. However, lubricants tend to change the operational characteristics of the electrophotographic system undesirably.

In addition to the problem of wear, which is more or less predictable over time, cleaning blades are also subject to unpredictable failures. In normal operational configuration, with a coefficient of dynamic friction in the range of about 0.5 to 1.0, a blade cleaning edge or tip in sealing contact with the photoreceptor is tucked slightly. The cleaning blade is not in intimate contact with the photoreceptor, but slides on toner particles and lubricant to maintain the sealing contact required for cleaning. In this configuration however, the cleaning blade may flatten toner that passes under the blade and cause impaction of toner on the surface. The impact from carrier beads remaining on the charge retentive surface subsequent to development may damage the cleaning blade, and sudden localized increases in friction between the cleaning blade and surface may cause the phenomenon of tucking, where the blade cleaning edge becomes tucked underneath the blade, losing the frictional sealing relationship required for blade cleaning. These problems require removal and replacement of the cleaning blade because the blade tears or is so distorted in shape that it no longer functions.

Cleaning blades might also be used for the removal of toner from the surface of a detoning roll used to collect toner from the bristles of a brush cleaner, as shown for example in U.S. Pat. No. 4,819,026 to Lange et al., and assigned to the same assignee as the present application.

U.S. Pat. No. 4,501,486 to Landa shows a wiper blade for a liquid development type electrophotographic copier, which provides a compliant conductive cleaning blade, with a bias applied, for cleaning a liquid developed imaging surface, with a removable cleaning edge less conductive than the blade body. U.S. Pat. No. 4,319,831 to Matsui et al. describes conductive fibers for a brush cleaner which have a conductive layer and non-conductive layer. U.S. patent application Ser. No. 338,698, filed Apr. 13, 1989, and assigned to the same assignee as the present application, discloses a cleaning blade made from a fiber filled elastomer with fibers oriented generally in the process direction. Xerox Disclosure Journal, Vol. 1, No. 4, Apr. 1976, entitled "Impregnated Poromeric Material Cleaning Blade" by Spencer et al., suggests the desirability of impregnating a poromeric cleaning blade with conductive material for control of resistivity and/or electrical biasing of the blade edge.

SUMMARY OF THE INVENTION

In accordance with the invention there is provided an arrangement for detecting the condition of the cleaning edge of a cleaning blade for removal of residual toner from an imaging surface in an electrophotographic device.

In accordance with one aspect of the invention, an elastomeric cleaning blade supported in cleaning relationship with the imaging surface of an electrophotographic device, for removal of residual toner from the surface, is provided with a conductive material region at the cleaning edge of the cleaning blade. An electrical signal is applied to the conductive material region, and the electrical characteristics of the cleaning edge are monitored. Change in the electrical characteristics of the cleaning blade edge will be highly indicative of a cleaning blade failure, or impending failure. A signal based on the variations in electrical characteristics with respect to a reference voltage may be produced to create a warning indication or cause a corrective response to occur.

In accordance with another aspect of the invention, a surface adjacent the cleaning edge of the cleaning blade may be provided with a conductive coating. As the coating wears or tears, conductivity across the cleaning edge will decrease in a detectable manner. When the decrease reaches a predetermined value, a blade failure may be indicated.

In accordance with another aspect of the invention, a cleaning blade may be fabricated to include a conductive fiber/elastomer composite with the conductive fibers oriented uniaxially and transverse to the process direction, at the cleaning edge of the blade, adjacent the surface thereof. The conductivity across the blade edge would be strongly anisotropic, i.e., very high in the lengthwise direction, but very low in the process direction. Tears and distortions in the blade edge will cause conductivity along the cleaning edge to decrease in a detectable manner. When the decrease reaches a predetermined value, a blade failure may be indicated.

These and other aspects of the invention will become apparent from the following description used to illustrate a preferred embodiment of the invention read in conjunction with the accompanying drawings in which.

Figure 1:
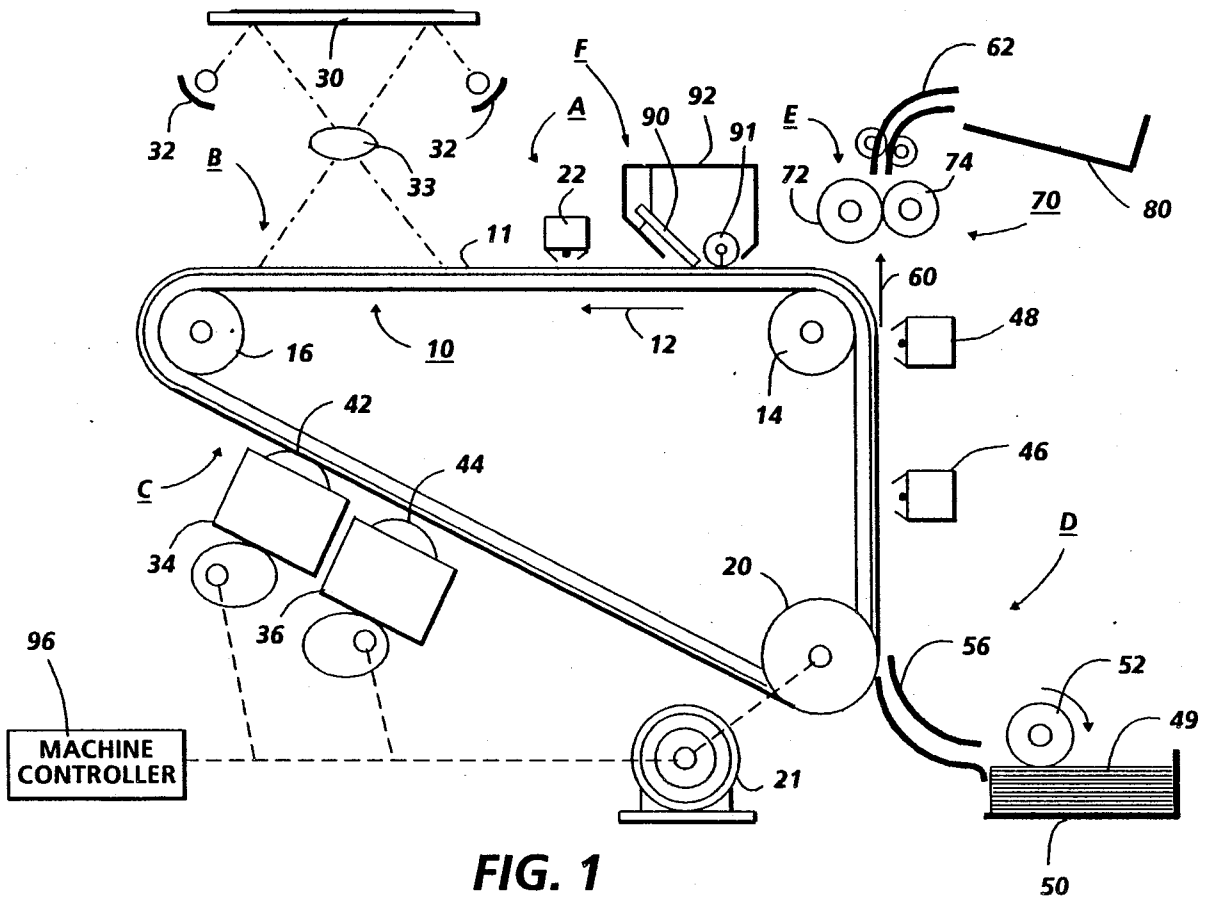
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine in which the present invention finds advantageous use utilizes a photoreceptor belt 10, having a photoconductive surface 11. Belt 10 moves in the direction of arrow 12 to advance successive portions of the belt sequentially through the various processing stations disposed about the path of movement thereof.

Belt 10 is entrained about stripping roller 14, tension roller 16, and drive roller 20. Drive roller 20 is coupled to a motor 21 by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a corona device 22 charges photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto a charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system, such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10. If two colors of developer material are not required, the second developer housing may be omitted.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of substrate or support material 49 are advanced to transfer station D from a supply tray 50. Sheets are fed from tray 50 with sheet feeder 52, and advanced to transfer station D along conveyor 56. After transfer, the sheet continues to move in the direction of arrow 60 to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet, and such sheets are directed to an output 80 or finisher.

Residual toner and debris remaining on photoreceptor belt 10 after each copy is made, may be removed at cleaning station F with the combination of a cleaning blade 90 and auger toner remover 91 within a housing 92. Removed residual toner may be stored for disposal or returned to the developer for re-use.

Machine controller 96 is preferably a known programmable controller or combination of controllers, which conventionally control all the machine steps and functions described. Controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention.

Figure 2A:
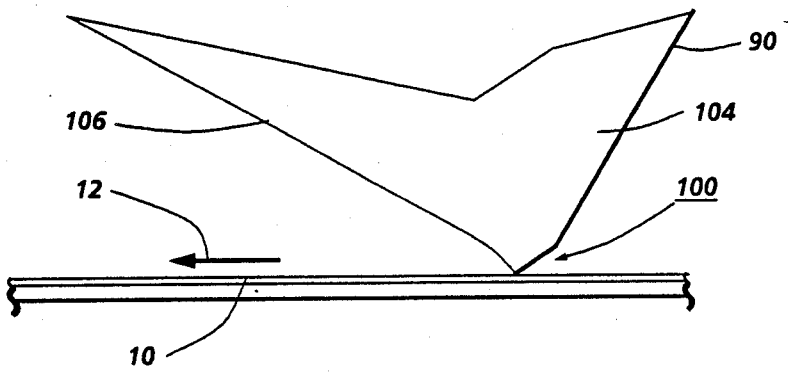
FIGS. 2A, 2B and 2C show a sequence of views of a cleaning blade in operative condition.
Figure 2B:
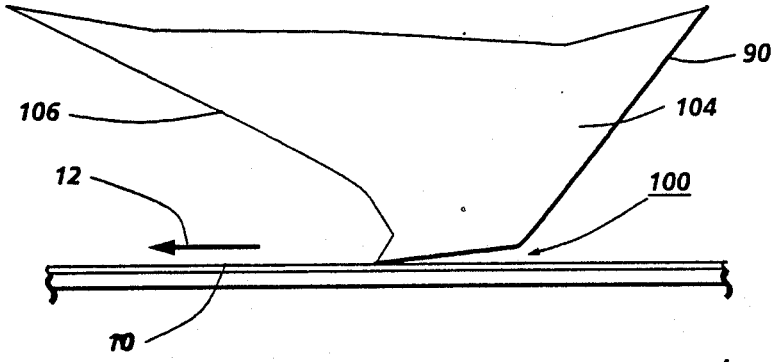
Figure 2C:
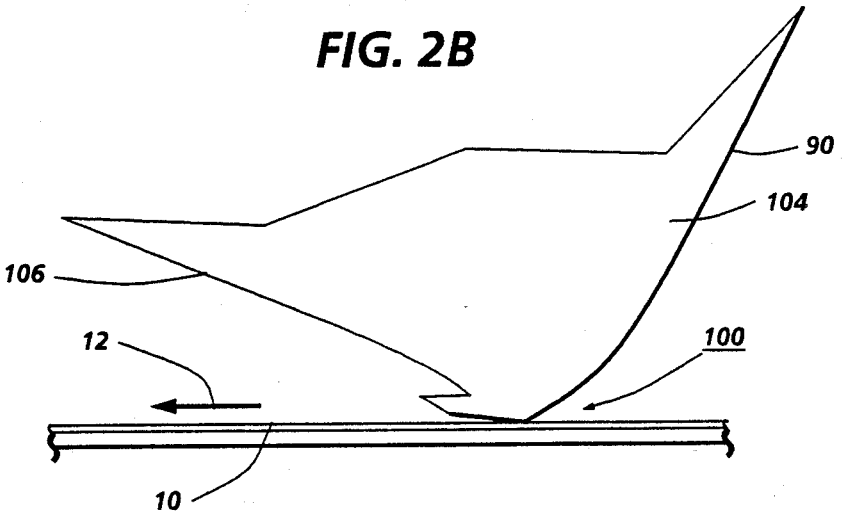
Figure 3:
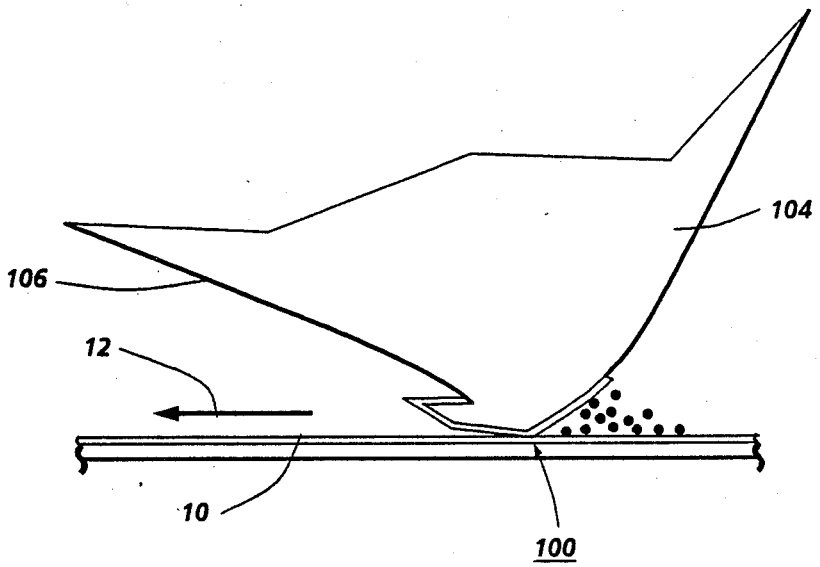
FIG. 3 shows one embodiment of the invention wherein a cleaning blade is provided with a conductive surface at a cleaning edge thereof.

Cleaning blade 90 is an elastomeric member typically of a urethane or similar material which slightly tucks at cleaning edge 100 to ride on toner in cleaning relationship with photoreceptor belt 10. The degree of tuck is dependent on the load, which is shown increasing in the sequence of FIGS. 2A, 2B, and 2C. When tucked, the elastomeric blade material is considerably stretched or elongated and may curl away from the surface of photoreceptor belt 10. The extent of the deformed area is typically in the range of 1 to 10 microns. In accordance with the invention, and as seen in FIG. 3, a conductive surface layer 102 can be applied to surfaces 104 or 106 or both, to achieve a conductive cleaning edge. The area that may be covered with the conductive surface layer 102 is variable, but optimally should be limited as much as possible to the area of deformation, as illustrated in FIG. 3.

Figure 4A:
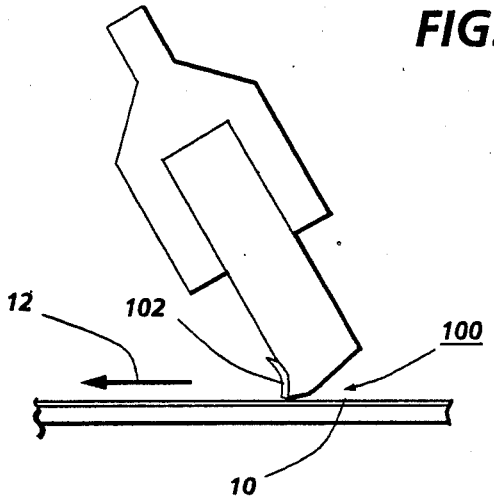
FIGS. 4A and 4B show alternative arrangements of the conductive surface at a cleaning edge with respect to cleaning blades in doctoring and wiping modes.
Figure 4B:
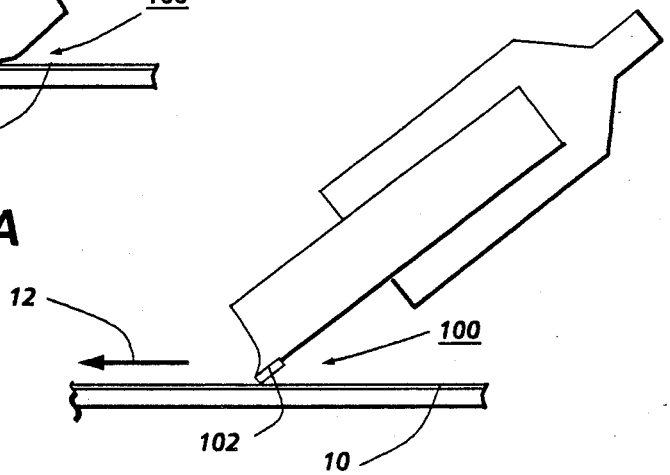

A variety of materials and methods of application of the conductive surface layer 102 to cleaning blade 90 to achieve a conductive cleaning edge are possible. The elastomeric material for cleaning blades is usually prepared first in sheet form. A large sheet of the desired material may be uniformly plated or coated on one side, and then patterned into an array of narrow stripes by the use of photoresists and plating etches or solvents for the conductive material. The stripes would be separated by spaces equal to the cleaning blade width. The sheet would subsequently be cut along the conductive stripes to separate and provide individual cleaning blades. The conductive stripe is then on the uncut surface of the cleaning blade at the edge. If the cleaning blade is used in the "doctor blade" mode, for chiseling removal of toner, as shown in FIG. 4A, the coated surface is on the concave surface of the tuck, does not touch the photoreceptor and will be sensitive only to tears. On the other hand, if a blade prepared in this manner is used in the "wiper blade" mode, as shown, in FIG. 4B, the conductive stripe contacts the photoreceptor and will wear. A gradual decrease in conductance is therefore a measure of wear. Abrupt changes measure tears, or "plowing" induced defects.

The conductive stripe may also be a conductive ink printed on the cleaning blade material in an array of narrow lines before cutting. Other methods of preparing selectively conductive surfaces are ion implantation, doping the material with reactive or conductive agents, or one of several forms of laser processing. Lasers can be used to expose photoresists, to ablate chemical resists, to pyrolyze a line of semiconducting graphitic char on the substrate blade material, to initiate reactions such as deposition of metal films on irradiated surfaces in the presence of organometallic vapors, to promote diffusion of dopants into the elastomeric material in the irradiated area, or to decompose metallic salts on the surface to produce free metal in sufficient quantities to be conductive in itself or, in lesser quantities, acting as the catalyst for electroless plating.

It may also be possible to coat the cut surface, or both the cut and uncut surfaces at the cleaning edge of the cleaning blade by printing, laser processing, etc. While the cleaning blades must then be prepared individually, there is an advantage in that the conductive stripe is placed on the blade after the cutting operation and therefore not in danger of damage during cutting. If the conductive coating is on the cut surface, the "wiper blade" and "doctor blade" options described above would be reversed in their placement of the conductive surface on the photoreceptor.

It may also be possible to coat the edge of the cleaning blade during the cutting operation with, for example, an inking tool or pen which follows the cutting tool. This would enable precise placement of a fine conductive line, which is desirably less than five thousandths of an inch wide. The entire cleaning edge of the cleaning blade may be brought into contact with an inked plate with the blade at some angle other than 0, or 90° to the plate. Then both cut and uncut surfaces could be simultaneously coated to controlled dimension determined by the ink depth on the plate.

Figure 5:
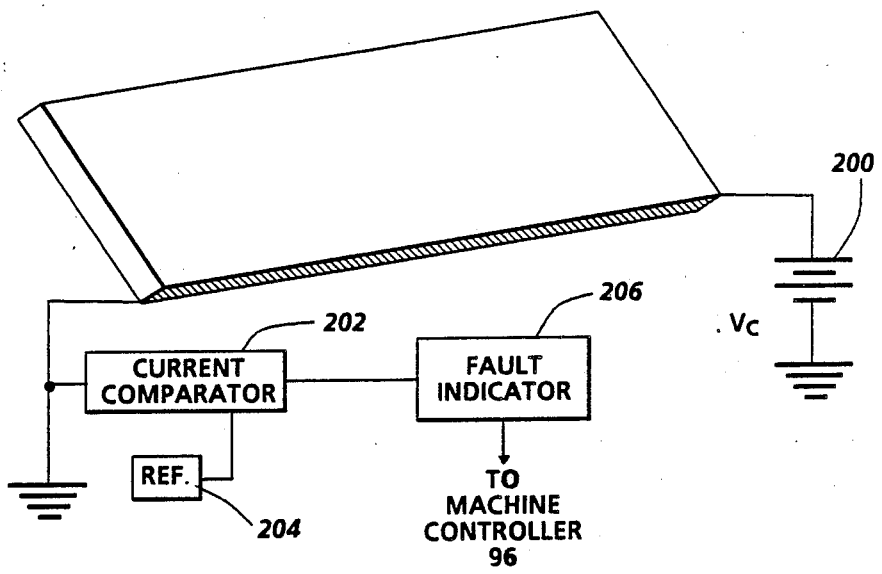
FIG. 5 shows a fault detection circuit for use with the inventive cleaning blade.

With reference to FIG. 5, a voltage source 200 applies a voltage $V_C$ across thin conductive layer 102, creating a measurable current I through the layer, variable with the resistance of the layer. The total resistance of the layer will typically fall in the range of $10^2$ to $10^9$ ohms and the desired sensed current determined by detector sensitivity, noise and the available voltage $V_C$. The current I will generally be in the range $10^{-3}$ to $10^{-9}$ amperes. Variations in that current are detectable by current comparator 202, which compares detected current with the reference or initial value 204. Breakage or distortion or a significant change in the thin conductive layer results in a significant increase in resistance across the cleaning blade, and a decrease in current to the comparator. It is important that any break which occurs at the blade cleaning edge substantially interrupts the flow of current to the extent of at least 5% to 100%, so that the change in current can be detected and differentiated from any electrical noise which may be caused by friction charging of the two surfaces. It is known that one type of damage resulting in cleaning failure can be a tear in the cleaning edge extending into the cleaning blade at least a toner particle diameter, or typically a distance greater than about 0.0005", but less than about 0.001" from the cleaning edge. The maximum width of the conductive stripe should therefore be in the range of about 0.020" so that the resulting change in resistance due to a 0.001" tear can be detectable. It is also desirable for the conductive stripe to be as narrow as possible and as close to the cleaning edge as possible. When the current varies significantly from the reference value, a cleaning failure is indicated at fault indicator 206, which provides a signal to machine controller 96 indicating a cleaning failure, which might, for example cause a warning light to appear at a user interface display. Alternatively, the output to the machine controller indicating a cleaning failure could be used to signal machine controller 96 to move a new cleaning blade into cleaning position, when a cleaning blade carrousel, such as in Japanese Laid Open patent application No. 61-122679, is used.

Figure 6:
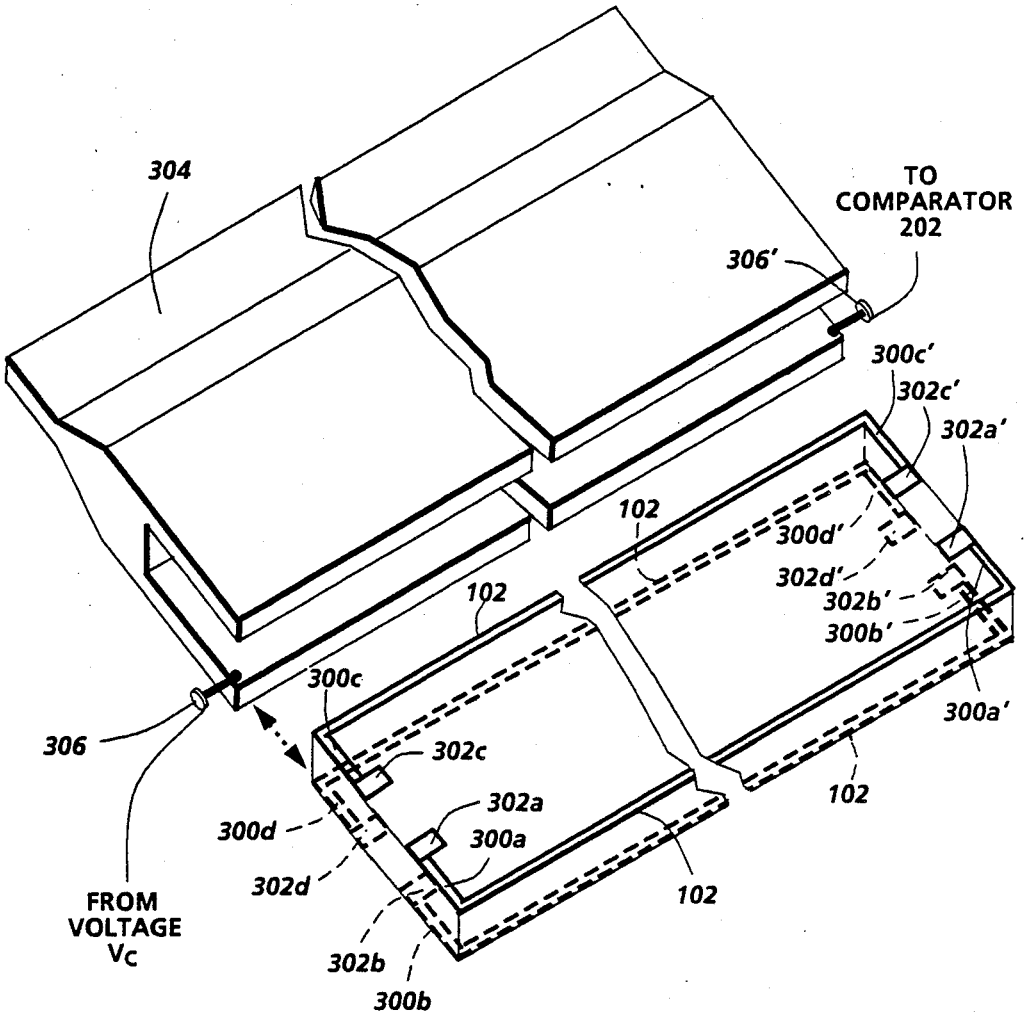
FIG. 6 shows a blade support arrangement for use in conjunction with the present invention.

As shown in FIG. 6, when one blade edge is worn, as determined by detection of a change in electrical characteristics therefrom, it may be a practice, to remove the cleaning blade from a holder, rotate the blade to provide a new edge on contact with the surface to be cleaned, and reinstall the blade in a blade holder. In this manner four long edges, 102a, 102b, 102c, 102d of the blade, each provided with a conductive stripe might be used sequentially to extend the life of the blade by a factor of four. To provide the defect sensing ability being described here, the conductive stripes would be applied to the four long edges of the blade.

Connection of any of the conductive edges 102 of a cleaning blade 90 to the fault detection arrangement may be made in a variety of ways, including, as shown in FIG. 6, by providing conductive strip extensions 300a, 300a', 300b, 300b', 300c, 300c', 300d, 300d', leading from the conductive edges 102 of the cleaning blade 90 to contact pads 302a, 302a', 302b, 302b', 302c, 302c', 302d, 302d', spaced from the cleaning edges of the cleaning blade, along non-cleaning edges of the cleaning blade. If a cleaning blade holder 304, adapted to receive the cleaning blade to support the blade in cleaning position, is a non-conductive or insulative member, connections may be provided therein using connectors or clips 306 appropriately positioned within the holder, and connected to voltage source 200 and current comparator 202.

Figure 7:
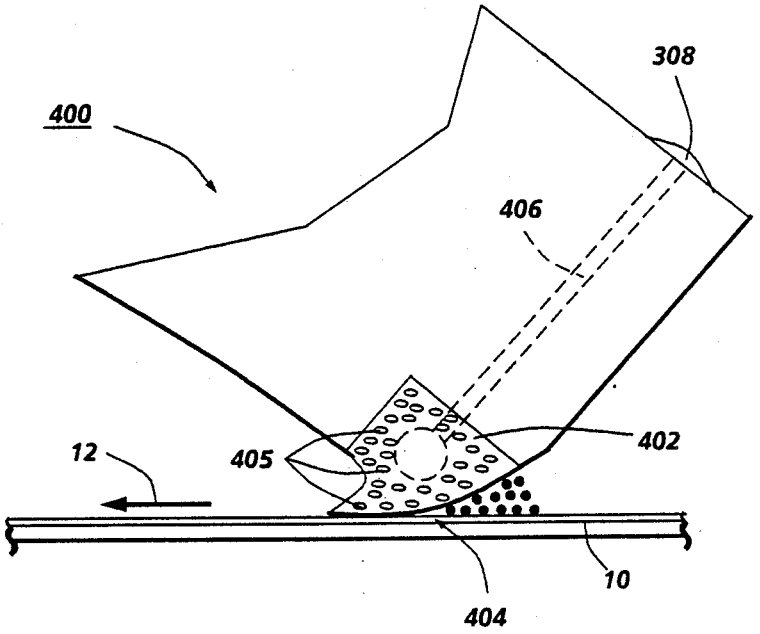
FIG. 7 show another embodiment of the invention wherein a cleaning blade is provided with a conductive region at a cleaning edge thereof.

In accordance with another embodiment of the invention, instead of applying a thin conductive coating or layer to the exterior of the cleaning blade edge, as shown in FIG. 7, a cleaning blade 400 may be fabricated to include conductive fiber/elastomer composite at least in the region 402 at cleaning edge 404, with electrically conductive fibers 405 oriented uniaxially across the blade, transverse to the process direction, at the cleaning edge 404 of the cleaning blade, adjacent the surface thereof. The conductivity across the blade edge would be strongly anisotropic, i.e., much higher in the lengthwise direction along the edge than in any direction perpendicular to the orientation of the fibers. Depending on the perfection of the placement of these fibers, or the degree of anisotropic conductivity, the entire blade material may be so composed. Resistance at the cleaning edge may sampled by placement of conductive electrodes 406 sized on the order of approximately 0.005" at the non-cleaning end surfaces of the cleaning blade 400, as close to the cleaning edge 404 as possible. Electrodes 406 are preferably thin conductive films, although embedded fine wires may also be acceptable. Electrodes 406 are connected, to surface electrodes 408 located at positions that will not interfere mechanically with the action of the blade edge, which are ultimately terminable at electrical contact positions for connection power supply and fault detection circuitry. In the case that the entire blade is formed from the conductive fiber/elastomer composites an insulator layer on the non-cleaning end surfaces of the blade everywhere except region at the end of region 402 will allow the conductive electrodes to be extended on top of the insulator layer up to the blade holder as before where the connector and leads or wires. Tears and distortions in the blade edge will cause conductivity across the cleaning edge to decrease in a detectable manner. When the decrease reaches a predetermined value, a blade failure may be indicated.

It is believed that the conductive fibers may be molded into the blade body in a molding process. It is also believed that the fiber will act as a reinforcement of the cleaning blade edge to achieve longer life through improved wear resistance and increased lubricity. A number of conductive fibers may be suitable for this purpose. Carbon fibers are preferred for their flexibility but a variety of other conductive fibers may be used such as fine diameter stainless steel or doped rayon or nylon fibers.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

I claim:

1. A cleaning blade for use in removal of dry toner from a surface in an electrostatographic device, said cleaning blade comprising:

a cleaning blade body formed from an elastomeric material;

at least one cleaning edge formed on the blade body, and adapted for cleaning contact with the surface in an electrostatographic device;

said at least one cleaning edge having predetermined and detectable electrical characteristics, variable with wear and damage.

2. The cleaning blade as defined in claim 1 wherein a conductive surface is provided at the cleaning edge, the conductive surface providing predetermined and detectable electrical characteristics variable with wear and damage of the cleaning edge.

3. The cleaning blade as defined in claim 2 wherein a conductive surface is formed at the cleaning edge by applying an exterior coating of conductive material.

4. The cleaning blade as defined in claim 1 wherein a conductive surface is provided at the cleaning edge, the conductive surface providing predetermined and detectable electrical characteristics variable with wear and damage of the cleaning edge, and the conductive surface is formed at the cleaning edge by ion implantation of a conductive material.

5. The cleaning blade as defined in claim 1 wherein a conductive surface is provided at the cleaning edge, the conductive surface providing predetermined and detectable electrical characteristics variable with wear and damage of the cleaning edge, and the conductive surface is formed on the surface by doping with conductive agents.

6. The cleaning blade as defined in claim 1 wherein a conductive region is provided in the blade body at the cleaning edge, the conductive region providing predetermined and detectable electrical characteristics variable with wear and damage.

7. The cleaning blade as defined in claim 6 wherein a conductive region is formed with a conductive fiber and elastomer composite.

8. The cleaning blade as defined in claim 7 wherein the conductive fiber is a conductive carbon material.

9. The cleaning blade as defined in claim 1 including means on said cleaning blade body, electrically connected to said cleaning edge, for forming electrical contacts thereon, spaced from the cleaning edge.

10. In an electrostatographic imaging device providing a cleaning blade for removal of residual toner from a surface subsequent to the imaging process, the cleaning blade subject to wear and damage, a cleaning blade defect detecting arrangement comprising:

a cleaning blade body formed from an elastomeric material;

at least one cleaning edge formed on the cleaning blade body, and adapted for cleaning contact with a surface;

said at least one cleaning edge having predetermined and detectable electrical characteristics, variable with wear and damage;

means for monitoring the electrical characteristics of the cleaning edge; and means for detecting variations in the monitored electrical characteristics of the cleaning edge.

11. The device as defined in claim 10 wherein a conductive surface is provided at the cleaning edge, the conductive surface providing predetermined and detectable electrical characteristics variable with wear and damage of the cleaning edge.

12. The device as defined in claim 11 wherein the conductive surface is formed by applying a coating of conductive material to the blade body at the cleaning edge.

13. The cleaning blade as defined in claim 10 wherein a conductive surface is provided at the cleaning edge, the conductive surface providing predetermined and detectable electrical characteristics variable with wear and damage of the cleaning edge, and the conductive surface is formed at the cleaning edge by ion implantation of a conductive material.

14. The cleaning blade as defined in claim 10 wherein a conductive surface is provided at the cleaning edge, the conductive surface providing predetermined and detectable electrical characteristics variable with wear and damage of the cleaning edge, and the conductive surface is formed on the surface by doping with conductive agents.

15. The device as defined in claim 10 wherein a conductive region is provided in the blade body at the cleaning edge, the conductive region providing predetermined and detectable electrical characteristics variable with wear and damage.

16. The device as defined in claim 15 wherein a conductive region is formed with a conductive fiber and elastomer composite.

17. The device as defined in claim 16 wherein the conductive fiber is a conductive carbon material.

18. The device as defined in claim 10 including means on said cleaning blade body, electrically connected to said cleaning edge, for forming electrical contacts thereon, spaced from the cleaning edge.

19. The device as defined in claim 10 wherein the means for monitoring the electrical characteristics of the cleaning edge includes a power supply electrically connected to said cleaning edge to produce a detectable current therethrough.

20. The device as defined in claim 10 wherein the means for detecting variations in the monitored electrical characteristics of the cleaning edge includes a comparator, comparing monitored electrical characteristics of the cleaning edge with a reference.

21. The device as defined in claim 20 wherein the means for detecting variations in the monitored current through the cleaning edge further includes a fault detector which produces a fault signal when monitored electrical characteristics of the cleaning edge vary in comparison to the reference.

22. In an electrostatographic imaging device providing cleaning blade removal of residual toner from a surface subsequent to the imaging process, the cleaning blade subject to wear and damage, a cleaning blade defect detecting arrangement comprising:

a cleaning blade support;

a cleaning blade body formed from an elastomeric material;

a cleaning edge formed on the cleaning blade body, and adapted for cleaning contact with a surface;

the cleaning blade support receiving and supporting said cleaning body so that the cleaning edge is in cleaning contact with the surface;

said cleaning edge having predetermined and detectable electrical characteristics, variable with wear and damage;

a power supply for providing a current through the cleaning edge;

means for monitoring the changes in the current through the cleaning edge; and means for detecting variations in the monitored current through the cleaning edge to produce a fault signal.

23. The cleaning blade as defined in claim 22 further including means on said cleaning blade body, electrically connected to said cleaning edge, for forming electrical contacts thereon, spaced from the cleaning edge.

24. The device as defined in claim 18 wherein the cleaning edge is electrically connected to electrical contacts on said blade body, for electrical connection to complementary contacts on the cleaning blade support, and said cleaning blade support electrically connected to said monitoring means.

25. The device as defined in claim 24 wherein the monitoring means includes a power supply electrically connected through said support to said cleaning edge to produce a detectable current therethrough.

26. The device as defined in claim 25 wherein the means for detecting variations in the monitored electrical characteristics of the cleaning edge includes a comparator, electrically connected through said support to said cleaning edge, detecting current therethrough and comparing monitored current through the cleaning edge with a reference.

27. The device as defined in claim 20 wherein the means for detecting variations in the monitored current through the cleaning edge further includes a fault detector which produces a fault signal when monitored current through the cleaning edge varies in comparison to the reference.

* * * * *